US005180538A

United States Patent [19]

Vatant et al.

[11] Patent Number: 5,180,538

[45] Date of Patent: Jan. 19, 1993

[54] DEVICE AND METHOD FOR FEEDING MOLTEN METAL FOR THE PRESSURE CASTING OF METAL PRODUCTS

[75] Inventors: Robert A. Vatant, Saint-Chamond; Michel F. Courbier, Le Breuil; André Weiss, Saint-Chamond, all of France

[73] Assignees: Creusot-Loire Industrie, Puteaux; Clecim, Pontoise, both of France

[21] Appl. No.: 720,780

[22] PCT Filed: Jan. 16, 1990

[86] PCT No.: PCT/FR90/00033

§ 371 Date: Sep. 10, 1991

§ 102(e) Date: Sep. 10, 1991

[87] PCT Pub. No.: WO90/08002

PCT Pub. Date: Jul. 26, 1990

[30] Foreign Application Priority Data

Jan. 16, 1989 [FR] France ..... 89 00840

[51] Int. Cl.[5] ..... B22D 41/00

[52] U.S. Cl. ..... 266/91; 266/236; 266/276

[58] Field of Search ..... 266/165, 236, 276, 239, 266/91

[56] References Cited

U.S. PATENT DOCUMENTS 4,678,167 7/1987 Lemper ..... 266/165
4,742,994 5/1988 Zannini et al. ..... 266/276

FOREIGN PATENT DOCUMENTS 0270466 6/1988 European Pat. Off. .
2933762 3/1981 Fed. Rep. of Germany .

OTHER PUBLICATIONS

Patent Abstracts of Japan, vol. 6, No. 190 (M-159) (1068) Sep. 29, 1982 & JP, A, 5797860, Jun. 17, 1982.

*Primary Examiner*—Scott Kastler
*Attorney, Agent, or Firm*—Cushman, Darby & Cushman

[57] ABSTRACT

Device and method for feeding molten metal for the pressure casting of metal products.

The device for feeding molten metal to a mould 1 of a continuous pressure-casting installation comprises a vessel 2 equipped with a cover 7 carrying a spout 3, the said vessel resting on a frame 4 and comprising a framework 9 for supporting a ladle 10 of molten metal, means for weighing the said ladle and means 20 for raising the said framework.

The casting method implementing this device is characterized in that, during the cast, when the quantity of metal in the ladle 10 is greater than a specific quantity, the ladle is held in a low position (position according to reference 32) and, when the quantity of metal becomes less than the said specific quantity, the ladle is raised (position 32') so as to hold the lower end 31 of the spout below the level of the metal contained in the ladle.

16 Claims, 4 Drawing Sheets

DEVICE AND METHOD FOR FEEDING MOLTEN METAL FOR THE PRESSURE CASTING OF METAL PRODUCTS

The present invention relates to an installation for pressure casting metal products, particularly steel slabs. More precisely, it relates to the device for feeding the mould with molten metal.

The well known principle of pressure casting consists in feeding the mould with molten metal at its lower part by means of a tube in refractory material immersed in a ladle containing the molten metal which is subjected to a pressure greater than that prevailing in the mould, the latter generally being atmospheric pressure. To this end, the ladle is enclosed in a leaktight vessel fed with compressed gas. The tube passes through a removable cover for the ladle and its upper end is connected to the mould by means of a valve which is itself fixed to the mould at its lower part. Through the action of the pressure of the gas, the molten metal in the ladle is pushed into the tube and then into the mould which it progressively fills. When the mould is full, the valve is closed, thereby preventing the metal contained in the mould from flowing when, after the cast, the pressure in the vessel is reduced to atmospheric pressure. The vessel may then be displaced on a carriage towards another mould or towards a waiting area where the cover is removed from the vessel in order to permit removal of the ladle therefrom with a view to its subsequent filling with molten metal.

Installations of this type are known, in particular those in which a movable carriage forms the frame carrying the vessel. The ladle is held in the vessel on a framework bearing on the bottom of the vessel, balances being placed between the frame and the vessel with a view to continually measuring the weight of the ladle and thus of the molten metal it contains. This measurement is used, in particular, to check the quantity of molten metal remaining in the ladle during and at the end of the cast. It is, in fact, necessary to know this quantity at the end of filling a mould in order to ensure that it is sufficient to totally fill the next mould. It is, above all, necessary to check it during the cast in order to prevent the level of metal in the ladle falling below the lower end of the spout, which would enable compressed gas to enter into the spout to the detriment of the quality of the cast product and, above all, of safety, this gas being liable to cause dangerous splashes of molten metal outside the mould.

Therefore, and also due to the fact that the lower end of the spout is necessarily at a certain distance from the bottom of the ladle in order to permit the passage of the molten metal, this results in a considerable quantity of molten metal remaining in the ladle at the end of a cast, which greatly reduces the yield of the installation. It is thus desirable to reduce this remainder in the bottom of the ladle as far as possible. A known solution consists in providing, in the bottom of the ladle, a dish with a cross-section which is slightly greater than that of the spout, but markedly smaller than that of the ladle, and in extending the spout so that its lower end penetrates into the dish. Thus, the quantity of metal which has to remain in the bottom of the ladle is considerably reduced.

This solution, however, has the drawback of limiting the passage section between the spout and the dish, which causes increased erosion of the latter and of the lower end of the spout. Moreover, impurities in the metal bath and those produced by the erosion of the refractory material of the dish and of the spout consequently tend to be entrained into the mould, which is detrimental to the quality of the product cast.

Another drawback is that in order to bring the lower end of the spout closer to the bottom of the ladle, the length of the spout must be increased. The brittleness of the spout is also increased and, because it is held only at its upper part in the vessel cover, the risk of breaking it is so much greater, above all during displacements of the vessel-holder carriage or during the various handling operations of the cover carrying the spout when it is being placed on the vessel.

In known pressure-casting installations, the ladle rests on a ladle-carrier framework bearing on the bottom of the vessel, the latter being fixed by means of its shell on the frame of the carriage. This arrangement has the drawback that all the weight of the ladle, in particular when it is full of molten metal, is supported by the vessel whose shell is then subjected to high stresses and which must therefore be sufficiently strong in order to support this load. The components of the vessel must therefore be of large size, which increases the weight of the vessel and makes its manufacture more complicated.

A still further drawback is that, in installations of the type described hereinabove, the devices for measuring the weight of the ladle are located in the vessel beneath the said ladle and risk being easily damaged if molten metal should overflow from the ladle.

The present invention aims to solve the various problems referred to hereinabove and, in particular, to limit as far as possible the quantity of molten metal remaining in the ladle after the cast or casts.

Another aim is to reduce the wear of the bottom of the ladle and of the spout.

With these objectives in view, the subject of the present invention is a device for feeding molten metal to a mould of a pressure-casting installation, comprising a vessel equipped with a cover carrying a spout, the said vessel resting on a frame and comprising a framework for supporting a ladle of molten metal, and means for weighing the said ladle.

According to the invention, the device is characterized in that it comprises means for raising the said framework relative to the said vessel. These raising means are provided in order to lift the ladle when the quantity of metal it contains is reduced so that the lower end of the spout is brought closer to the bottom of the ladle.

According to a particular arrangement of the invention, the framework for supporting the ladle comprises arms, extending radially and bearing on the weighing and raising means distributed at the periphery of the vessel and supported by the frame.

By virtue of this particular arrangement, the weight of the ladle is supported directly by the frame and the stresses applied to the vessel are thus considerably reduced, the latter now being subjected only to its own weight and to the stresses due to the pressure of the gas which is injected therein for the cast.

Another advantage of the device according to the invention is that, when the ladle contains a sufficient amount of molten metal, the end of the spout may be held relatively distant from the bottom of the ladle, thus limiting the problems of erosion and the risk of pollution of the metal referred to above. When the level of metal in the ladle reaches the vicinity of the bottom of the ladle, the latter is raised by virtue of the raising means, which makes it possible to use, to the maximum, the metal remaining in the bottom of the ladle and it is thus only at the end of draining the ladle that the passage section between the spout and the bottom of the ladle is reduced.

A still further advantage is to remove the risks of damage to the weighing and raising means by an overflow of molten metal by disposing said means at a sufficient distance from the ladle.

According to a particular arrangement of the invention, the said raising and weighing means are three in number, which ensures the isostatic disposition of the framework for supporting the ladle, and they are placed in cavities made in the wall of the vessel, extending beyond the perimeter of the latter and closed off by removable caps. Therefore, the said raising and weighing means are protected from possible overflows of metal and are, moreover, easily accessible for maintenance thereof from the outside of the vessel. Leaktight means are provided at the level of the weighing and raising means, between the vessel and the frame, in order to ensure the leaktightness of the vessel.

The invention also relates to a method for feeding molten metal to a pressure-casting mould using, in particular, the device according to the invention, this method being characterized in that, when the quantity of metal contained in the ladle is greater than a predetermined quantity, the ladle is held in a low position in which the lower end of the spout is distant from the bottom of the ladle and, when the quantity of metal contained in the ladle becomes less than the said predetermined quantity, the said ladle is raised without modifying the position of the tube, the raising height being determined as a function of the level of molten metal in the ladle, this level being determined on the basis of the weight of the ladle measured by the weighing means so as to hold the lower end of the spout below the said level of metal.

Moreover, the raising speed is determined such that the residence time of the spout at the bottom of the dish is reduced in order to avoid too rapid an erosion of the end of the spout and of the refractory materials of the dish.

Other characteristics and advantages will become apparent in the description which will be given by way of example of an installation and of a method for pressure casting according to the invention.

BRIEF DESCRIPTION OF THE DRAWINGS

Reference will be made to the appended drawings, in which:

In FIG. 1, the vessel and the mould are seen in the casting position. The mould 1, only the lower front part of which, comprising the feed orifice 11 for molten metal, is shown, comprises two large walls 12 disposed opposite one another. These walls 12 are separated by spacers 13, 14, 15 forming the small walls which have a width corresponding to the thickness of the cast product. The substantially horizontal lower spacer 13 is supported by a frame 16 which can tilt slightly about a horizontal shaft, not shown, located substantially half way along the total length of the mould so as to bring the feed orifice 11 closer to or to move it further away from the vessel 2. The substantially vertical front spacer 15 closes the mould at its front part and the upper spacer 14 closes it at its upper part. A fourth spacer, not shown, closes it at its rear part. The assembly of the walls 12 and the spacers thus forms a cavity of generally parallelepipedal form and with dimensions which correspond to the dimensions of the casting, in this case a steel slab.

Figure 1:
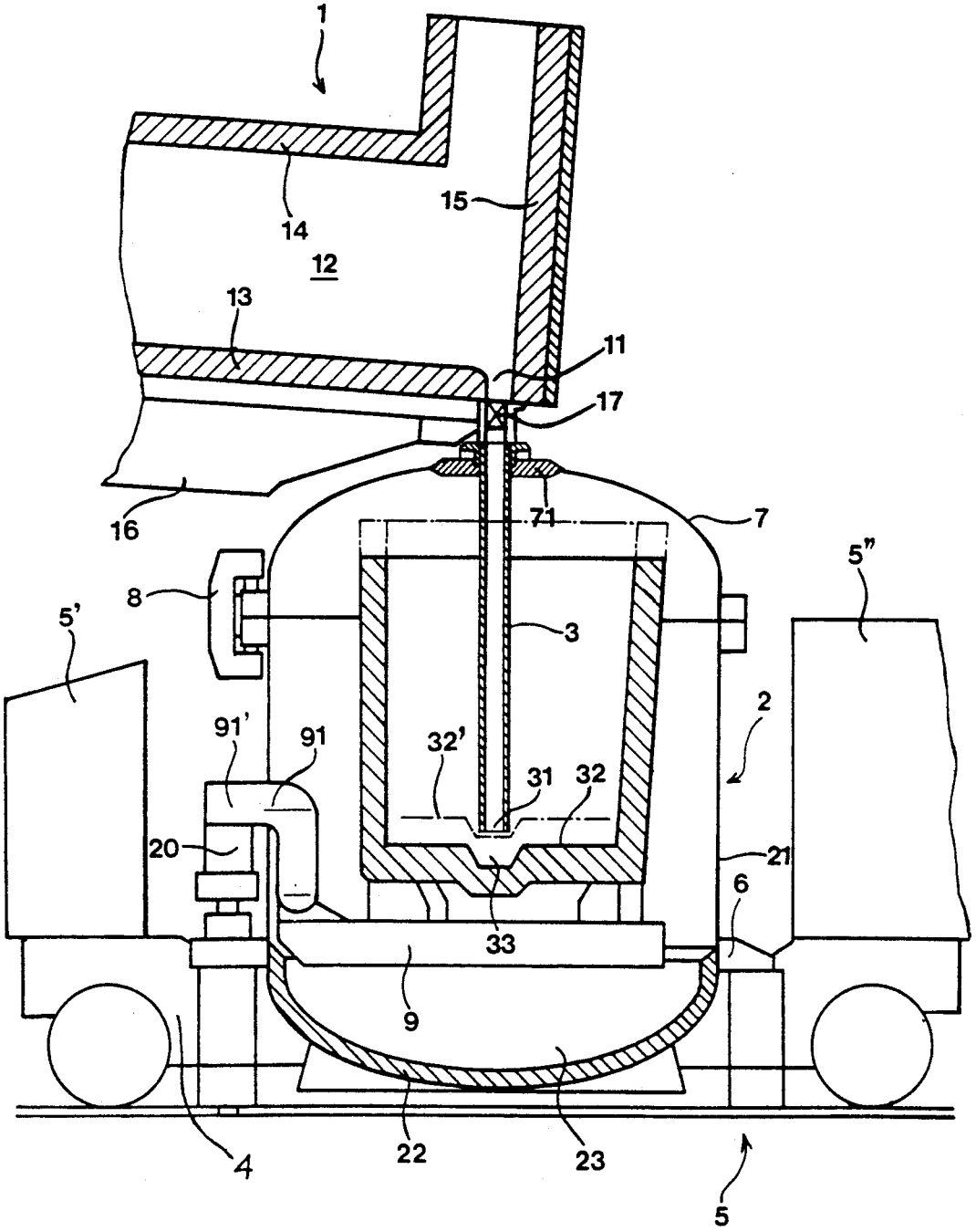
FIG. 1 is a partial diagrammatic view in section of a pressure-casting installation showing the general arrangement of the vessel, of the ladle and of the means for raising the latter.

The feed orifice 11 is provided, in a conventional manner, with a valve which is sketched at 17, the lower face of which bears in a leaktight manner, during the cast, on the upper end of the spout 3.

The device for feeding molten metal comprises a vessel 2 carried by a frame 4 of a carriage 5, making it possible to displace the assembly of the device in order to bring it into the casting position or to withdraw it from this position. The vessel 2 rests on the frame 4 by means of bearing elements 6 welded on the shell 21 of the vessel.

The vessel comprises a cover 7 and means 8 for locking this cover on the vessel.

A ladle-carrier framework 9 is arranged inside the vessel, on which framework the ladle 10 containing the molten metal rests. The ladle-carrier framework 9 is carried by arms 91 which are connected thereto in a removable or retractable manner. The arms 91 extend outwards from the vessel, beyond the shell 21 forming the vertical wall of the vessel and determining its perimeter, and bear on the frame 4 by means of weighing means 20' and raising means 20.

The bottom of the vessel is covered with a refractory lining 22 and the space 23, determined by this bottom and located beneath the ladle-carrier framework 9, is provided in order to have sufficient volume to collect virtually all the molten metal which the ladle 10 may contain if said metal should accidentally flow out of the ladle.

The carriage 25 (sic) also carries, at 5' and 5'', the apparatus necessary for feeding the vessel with compressed air and the apparatus for the systems for weighing and raising the ladle.

The spout 3 in refractory material is immersed in the ladle 10 up to a level close to the bottom of the latter but leaving, when the ladle 10 is in a low position (represented in solid lines in FIG. 1) a passage section of large size between the lower end 31 of the spout and the said bottom 32 so that the molten metal contained in the ladle can, during the cast, penetrate into the spout 11 (sic) at reduced speed at the level of this passage.

The bottom of the ladle 10 comprises a dish 33 with a cross-section which is slightly greater than that of the spout 3 so that, in a high position of the ladle (shown in dot-dash lines 32'), the lower end 31 of the spout penetrates into the dish 33 at a short distance from the bottom of this dish. The aim of this arrangement will be explained in greater detail hereinbelow, in connection with the description of the means for raising the ladle.

Figure 2:
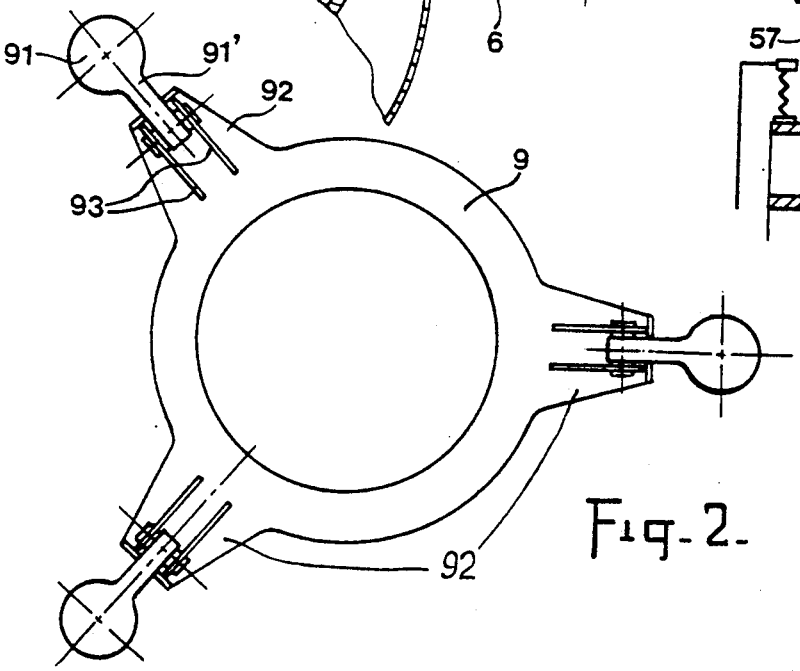
FIG. 2 is a plan view of the framework for supporting the ladle, showing the location of the means for raising the latter.

FIG. 2 shows in plan view the ladle-carrier framework 9. This comprises three lugs 92 extending radially outwards and on which are welded vertical parallel plates 93. Between the plates 93 of a single lug 92 is inserted the vertical part of a swan-neck arm 91, the horizontal part 91' of which extends radially outwards, beyond the shell 21 of the vessel 2, an opening 24 being made for this purpose in the shell. The arm 91 is held on the plates 93 by means of two pins 94, 95 of horizontal axis disposed one above the other.

The arms may therefore be removed from the framework 9 by simply removing the pins, which makes it possible, if necessary, to remove the framework 9 from the vessel 2 upwards without this removal being hindered by the projecting horizontal parts 91∝0 of the arms 91. If this operation proves necessary, it is still more advantageous to remove only the upper pin 94, it then being possible for the arm 91 to pivot inwards, as shown in dot-dash lines referenced 91'' in FIG. 3, by rotating about the lower pin 95. The arms 91 may then be retracted into an position inscribed inside the perimeter of the vessel while remaining attached to the ladle-carrier framework 9 without thereby interfering with the wall of the shell 21 during the removal of the said framework.

Figure 3:
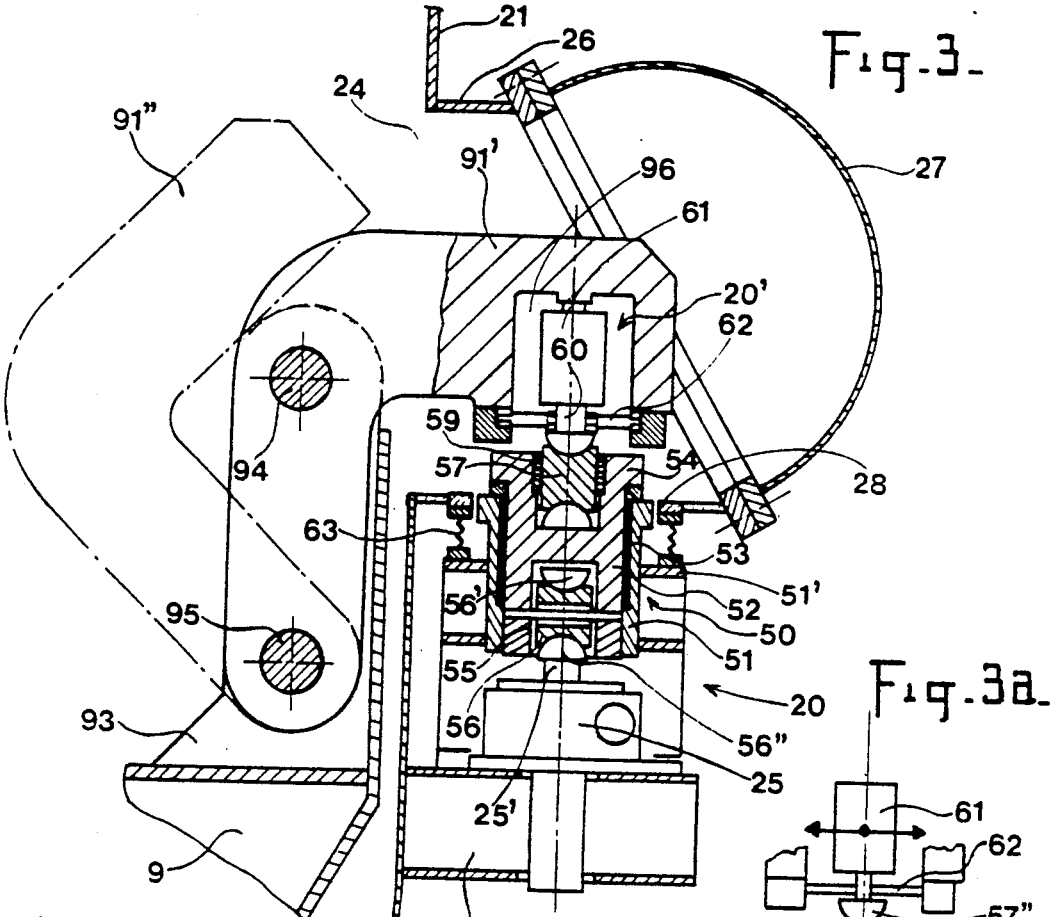
FIG. 3 is a sectional view of one of the raising and weighing means.
Figure 3A:
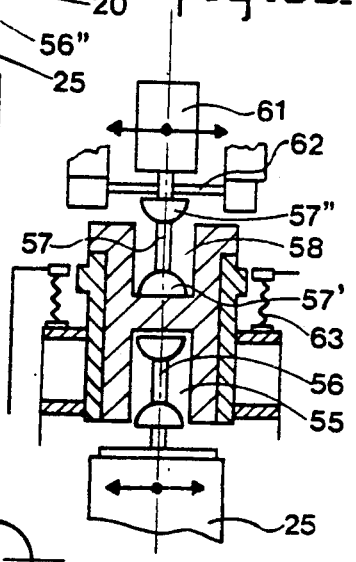
FIG. 3*a* is a diagrammatic view of one of the same raising and weighing means, showing its operating principle.

The means for weighing and raising the ladle will now be described in detail, in connection with FIGS. 3 and 3*a*.

As indicated hereinabove, the horizontal part 91' of the arms 91 extends outwards from the vessel through the opening 24 made in the shell 21 beyond the perimeter of the latter. The end of this horizontal part bears on the weighing means 20' and on the raising means 20, which rest on one of the bearing elements 6 of the vessel on the frame 4 of the carriage.

Each of the raising means 20 comprises a screwjack 25, placed so as to bear on the bearing element 6, and a stress transmission device 50. This stress transmission device comprises a guide column 52 which can slide in a sleeve 51 welded on a support 51' held rigidly on the bearing element 6. A seal 53 is interposed between the column 52 and the sleeve 51.

The column 52 comprises, at its upper part, a shoulder 54 which is capable of bearing on the upper end of the sleeve 51.

The column 52 comprises a lower blind vertical bore 55 in which is placed, with play, a lower thrust connecting rod 56. An upper pivot 56' is interposed between the connecting rod 56 and the bottom of the bore 55, and a lower pivot 56'' is interposed similarly between the connecting rod 56 and the movable rod 25' of the jack 25.

An upper thrust connecting rod 57 is mounted in an equivalent manner in an upper blind bore 58 of the column 52. This connecting rod 57 is held in the bore 58 by means of an elastic bush 59 which permits the respective free expansion of these two parts as well as a certain horizontal displacement of one relative to the other. A pivot 57' is interposed between the connecting rod 57 and the bottom of the bore 58. Another pivot 57'' is interposed between the upper end of the connecting rod 57 and a bearing rod 60 of a balance 61 placed in a recess 96 of the end of the horizontal part 91' of the arm 91. The balance is also held so as to bear, via its upper end opposite to the bearing rod 60, in the bottom of the recess 96 of the arm 91.

The bearing rod 60 of the balance is held fixed horizontally relative to the arm 91 by means of a double-membrane stabilization system. 62 which leaves the bearing rod 60 free to be displaced slightly vertically through the action of the load, while holding it horizontally and guiding it vertically.

In order to ensure the leaktightness of the vessel at the level of the passage of the arms 91, a sheet-metal casing 26 is welded on the shell 21 of the vessel around the orifice 24. This casing is provided with an inspection cover 27 permitting easy access to the weighing means 20' after pivoting of the arm 91.

The casing 26 comprises, at its lower part, an opening 28 through which the guide sleeve 51 freely passes, play being provided between these two pieces. The leaktightness of the vessel is ensured by means of a bellows joint 63 interposed between the casing 26, at the periphery of the opening 28, and the support 51' of the sleeve 51.

The various advantages resulting from the arrangement which has just been described are listed hereinbelow:

The positioning of the raising mechanism 20 outside the vessel avoids any problems of protecting the latter against heat, splashes of steel and any perforations of the ladle.

Supporting the ladle at three points is perfectly isostatic, and this is reflected in the stable and reliable supporting of the ladle.

The framework 9 for supporting the ladle consists of a simple circular caisson without complicated mechanisms. The only elements which are somewhat mechanical are the removable swan-neck arms 91 which make it possible to place the framework inside the vessel as well as to remove it.

The three supporting points are provided with balances 61 with stabilization membranes 62 and floating connecting rods 57 intended to compensate for the horizontal displacements which are due either to mechanical flexion under load of the framework or to inevitable thermal expansions which are due to the temperature prevailing inside the vessel.

The raising screw jacks 25 are both outside the vessel and attached thereto without, however, causing the weight of the ladle to rest on the shell of the vessel itself. This arrangement makes it possible to avoid the shell being stressed by loads which are due to the ladle and to the steel it contains while preserving the relative positions of the raising points and of the shell, even after thermal expansion.

The casings 26 of the vessel in which the weighing mechanisms are housed are equipped with removable covers which facilitate the inspection and maintenance thereof.

The pivots of the thrust connecting rods and support connecting rods of the ladle-carrier framework make it possible to avoid creating, in the raising columns, horizontal stresses which are detrimental because they cannot be controlled, and therefore the life span of the elements thereof is markedly improved.

The upper thrust connecting rods 57 are centred by means of the elastic bushes 59 which leave free the thermal deformations or mechanical flexions while keeping the ladle-carrier assembly centred.

The bellows joints 63 between the casings of the vessel and the supports of the guiding sleeves make it possible to avoid awkward machining of the vessel and permit precise positioning of the columns relative to the ladle support without thereby imposing manufacturing tolerances which are difficult to achieve. Moreover, these bellows absorb the differential expansions between the shell 21 of the vessel and the bearing elements 6 of the raising jacks.

It will be noted that, in the low position of the ladle-carrier framework, its weight and that of the ladle are transmitted to the frame by means of the shoulders 54 of the columns 52 which bear directly on the sleeve 51. In this position, play, which may be clearly seen in FIG. 3, is provided between the upper pivot 56' of the lower thrust connecting rod 56 and the bottom of the bore 55 of the corresponding column. Thus, in this position, the raising jacks are not stressed. This arrangement is particularly advantageous because, as will be explained hereinbelow, the ladle is held in a low position while the quantity of molten metal it contains is great and it is not raised until the end of draining. Therefore, the raising jacks are stressed only when the weight of the ladle-carrier framework and ladle assembly is the lowest, which makes it possible to use raising jacks of smaller capacity.

A description will be given of the means for fixing the spout on the cover of the vessel, in connection with FIGS. 4 and 5.

To this end, the cover is provided in its central upper part with a reinforcement 71 comprising a central bore 72 for the passage of a collar 73 which surrounds the spout 3, a refractory seal 74 cast between the collar 73 and the spout 3 ensuring their leaktight join.

A frustoconical machining is performed in the cover reinforcement 71, forming a frustoconical seating 75, 75' for a spherical bearing surface 76, 76' of an annular piece or ring 77, 77' supporting the collar 73. This arrangement forms a pivot system which permits a certain clearance in the positioning of the ring on its seating, while preserving the leaktightness of the join.

Figure 4:
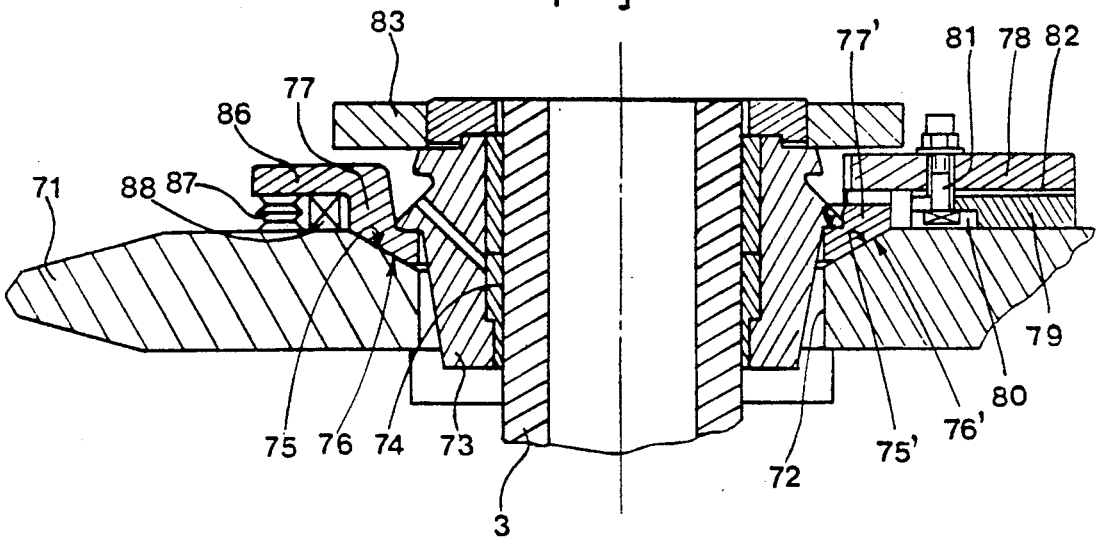
FIG. 4 is a view in axial section of the means for fixing the spout on the cover of the vessel, showing two alternative embodiments of these fixing means.
Figure 5:
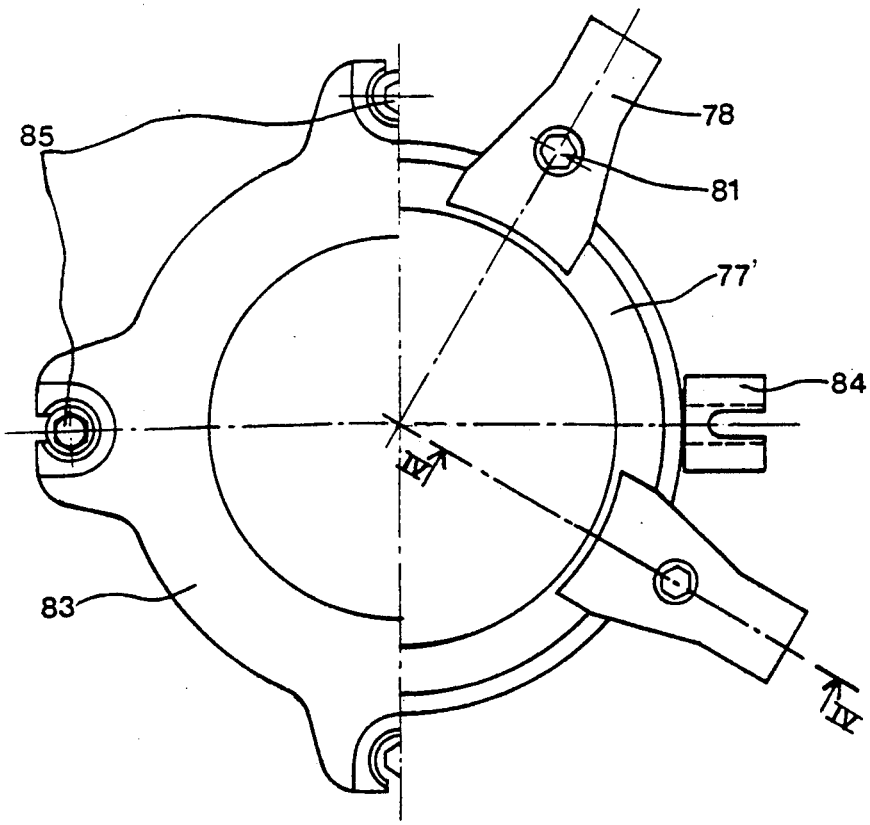
FIG. 5 is a plan view of these means.

A first embodiment is shown in the right-hand part of FIG. 4 and in FIG. 5, in which the right-hand part shows the fixing of the ring 77, and the left-hand part the fixing of the upper flange 83. In this embodiment, the ring 77' is held so as to bear on the frustoconical seating 75' by means of fixing members 78 called clips. These clips are bolted on to a bearing wedge 79 welded on the reinforcement 71 and comprising a groove 80 receiving the head of the bolt 81. Adjustable wedges 82 of thickness (sic) are interposed between the clips 78 and the bearing wedges 79. By changing the thickness of these wedges, it is possible to slightly modify the bedding of the ring 77' on its seating and thus to adjust the verticality of the spout 3. The collar 73 is held pressed against the ring 77' by means of a flange 83 fixed on the reinforcement 71 by bolts 85, the head of which engages under coupling pieces 84 welded on the reinforcement 71.

In the second embodiment shown in the left-hand part in FIG. 4, the annular piece or ring 77 comprises at least three lugs 86 which are circumferentially distributed, under which are placed springs 87 which keep the spout 3 suspended in a flexible manner in the absence of stress exerted vertically on the upper end of the latter. In this case, vertical play remains between the spherical bearing surface 76 of the ring and the seating 75 of the cover reinforcement 71. When the mould 1 of the casting installation is tilted into the casting position (as shown in FIG. 1), the lower part of the valve device 17 bears on the upper end of the spout 3. The springs 87 are compressed and the ring 77 bears on reference wedges 88 which determine the stable positioning of the ring and, consequently, the position of the spout. The thickness of the reference wedges 88 is preregulated so that the spherical bearing surface 76 of the ring 77 is pressed with sufficient stress against the seating 75 in order to ensure the leaktightness of the contact when the lugs 86 bear on the reference wedges 88. In this alternative embodiment, the spout and the collar 73 are preferably held rigidly relative to the ring 77 by means of clamping of the flange 83 on the said ring.

The two embodiments which have just been described aim essentially to facilitate the adjustment of the position of the spout 3 so that its lower end 31 corresponds perfectly with the dish 33 of the ladle. The difficulty of this positioning stems from the fact that there are several causes for offsetting originating from defects in the concentric and parallel alignments of the various elements present, in particular of variations in the positioning of the ladle 10 in the vessel 2, of the cover 7 relative to the vessel 2, and of the spout 3 relative to the collar 73, as well as of possible deformations in the cover and of the spout. All of these causes may be reflected in an offsetting of the lower end of the spout 3 relative to the dish 33 of the bottom of the ladle of the order of 80 to 100 mm.

It is thus necessary regularly to check and to regulate this positioning in order to avoid the lower end of the spout colliding with the bottom of the ladle when the latter is brought into the high position. In installations according to the Prior Art, in which the spout is clamped directly onto the cover, this regulation could be effected only by remachining the bearing surface of the flange on the cover or by inserting a bevelled annular wedge between the cover and the flange.

By virtue of the fixing system according to the invention, this regulation is greatly facilitated because of the spherical bearing surface of the intermediate annular piece 77, 77' which can pivot on the conical seating 75, 75' while maintaining the leaktightness of the vessel at the level of this join.

In the first alternative embodiment described hereinabove, it is sufficient, in order to perform this regulation, to modify the thickness of the regulating wedges 82 in order to adjust the bedding of the ring 77' on its seating 75' and thus the position of the spout 3.

In the second alternative embodiment it is the reference wedges 88 which determine the bedding of the ring 77 when the mould is tilted into the casting position and bears on the upper end of the spout. Moreover, in the absence of stress on this end of the spout, the assembly of the spout 3, the collar 73 and the ring 77 are (sic) slightly lifted relative to the cover by the springs 87, which ensures a certain freedom of movement for this assembly relative to the cover. This avoids, for example upon displacement of the carriage 5, the creation of considerable stresses in this fixing assembly which is subjected to the effects of the inertia of the spout and of possible jolts during displacement, stresses which would risk causing breakage of the spout if the latter were connected to the cover by means of rigid embedding.

Figure 6:
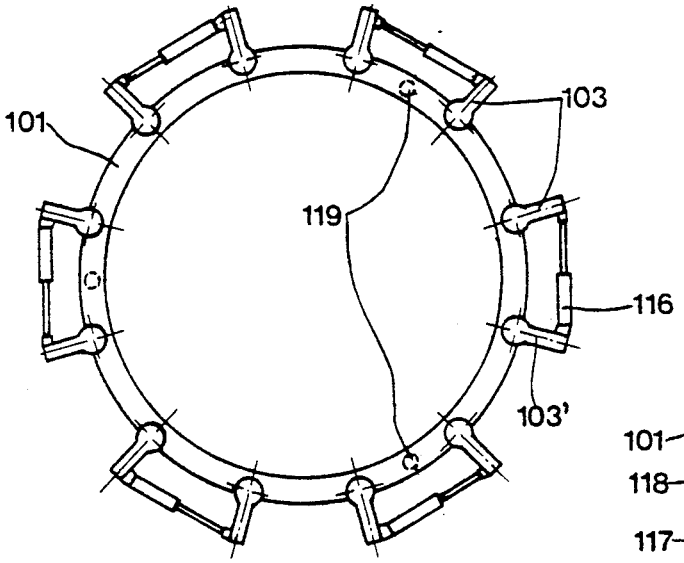
FIG. 6 is a partial plan view of the vessel showing the arrangement of the mechanisms for locking the cover.
Figure 7:
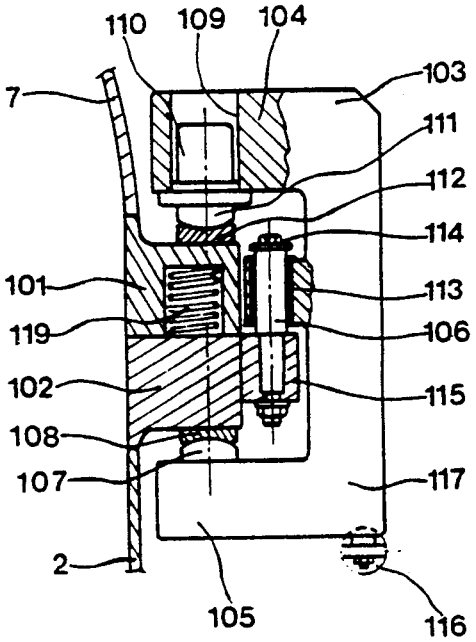
FIG. 7 is a diagrammatic sectional view of one of the mechanisms for locking the cover.

In connection with FIGS. 6 to 8, a description will now be given of the means for locking the cover 7 on the vessel 2.

In a generally known manner, in order to ensure the leaktight closing of the vessel 2 by the cover 7, these are equipped with flanges 101, 102, respectively, provided in order to come into leaktight contact on one another. In the particular arrangement of the means for locking the cover on the vessel according to the invention, these means comprise a plurality of C-shaped locking pieces, hereinafter called "Cs" 103, distributed circumferentially on the periphery of the vessel and the upper branches 104 and lower branches 105 of which surround the flanges 101, 102 in the locking position. The Cs 103 are mounted so as to pivot on the vessel by means of pivots 106 with a vertical axis which are fixed on the flange 102 of the vessel beyond the outer perimeter of the latter. The lower branch 105 of the C 103 carries a stop 107 facing the inside of the C and provided in order to bear, in the locking position, on a bearing plate 108 fixed under the lower face of the flange 102 of the vessel.

The upper branch 104 of the C comprises a bore 109 with a vertical axis in which is placed a hydraulic jack 110, the head of the movable rod 111 of which bears, in the locking position and when the jack is pressurized, on a second bearing plate 112 fixed on the upper face of the flange 101 of the cover.

Thus, in the locking position, the flange 102 of the vessel and the flange 101 of the cover are pressed on one another between the stops 107 and the heads 111 of the jacks, the latter providing the clamping pressure. As the jacks are fed from the same source, the clamping pressure is uniform over the entire periphery of the vessel.

Figure 6A:
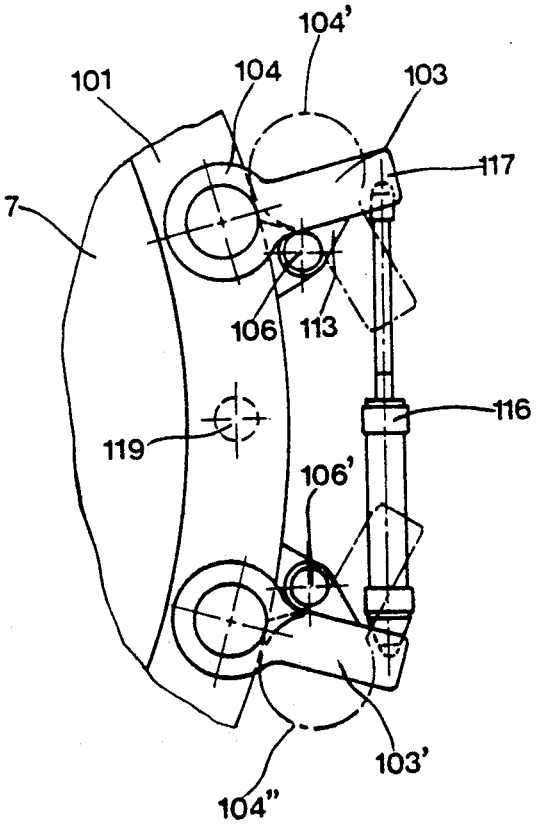
FIG. 6*a* is an enlarged view of an assembly of two of these mechanisms.

The position of the axis of the pivots 106 is such that, by pivoting the Cs 103 about this axis, the upper branch 104 may be brought into a release position 104' (shown in dot-dash lines in FIG. 6*a*), in which the cover 7 may be lifted without its flange 101 interfering with the said upper branch 104. To this end, the C 104 comprises a lug 113 located at the height of the flange 101 of the cover and forming a lateral protuberance of the C. The pivot 106 passes through a bore made in this lug 113 which can thus rotate on this pivot. A washer 114 screwed onto the upper end of the pivot prevents accidental release of the C upwards. Vertical play is provided between the lug 113 on the one hand and the washer 114 and the upper surface of the fixing piece 115 of the pivot on the flange 102 on the other hand, such that the C 103 has a certain latitude of vertical displacement when the clamping stress applied by the jack 110 tends to displace the C upwards in order to press its stop 107 against the bearing plate 108 of the flange of the vessel.

In order to ensure the pivoting of the Cs, these are functionally grouped in pairs. The two Cs 103, 103' of the same pair are adjacent and connected at their rear part 117 opposite to the branches 104, 105 by a dual-action hydraulic jack 116. Each of the pivots 106, 106' of the two Cs 103, 103' of a pair is offset laterally relative to the vertical median plane of the C in the direction of the other C, respectively 103', 103, of the same pair. In other words, the Cs 103, 103' are symmetrical relative to a vertical median plane equidistant from the two Cs of the same pair.

In the locking position of the cover, the jack 116 is in a position in which the rod is extracted. In order to unlock the cover, the pressure of the clamping jacks 110 is first cancelled and then the jacks 116 for controlling the pivoting are fed in order to retract their rod, which causes the pivoting of the two Cs of the same pair in opposite directions until their branches are brought into their release position 104', 104''.

The advantages of the means for locking the cover which have just been described lie, in particular, in the uniformity of the clamping over the entire circumference of the vessel and in the absence of a requirement for a specific orientation of the cover relative to the vessel, insofar as the bearing points of the clamping jacks 110 do not necessarily have a precise circumferential location on the flange of the cover. Moreover, even in the event of a leakage of hydraulic fluid over these clamping jacks or over their feed circuit, the cover is retained by the upper branches of the Cs, and can therefore be lifted only slightly through the action of the internal pressure of the vessel, thereby limiting the leakages of compressed gas contained in the vessel and also avoiding the ejection of the cover.

In order to guarantee the leaktightness at the level of the vessel/cover join and also to ensure centring of one relative to the other, a circumferential groove 117 may be machined in one of the flanges, the other comprising a rib 118 which penetrates into the said groove 117. A seal 125 is interposed in the bottom of the groove 117 and compressed by the rib 118 when the cover is clamped on the vessel.

In order to avoid shocks during the positioning of the cover on the vessel, dampers in the form of elastic elements 119, such as springs, are placed in blind bores made in the flange 101 of the cover. When the cover bears on the vessel, these elastic elements are compressed, as shown in FIG. 7, and are flush with the joining plane of the two flanges 101, 102. When the cover is lifted, these elastic elements are released and project beneath the lower face of the flange 101 of the cover. When the cover is being positioned, it is these elastic elements which first enter into contact with the flange 102 of the vessel, thereby damping the contact of the cover on the vessel.

Figure 8:
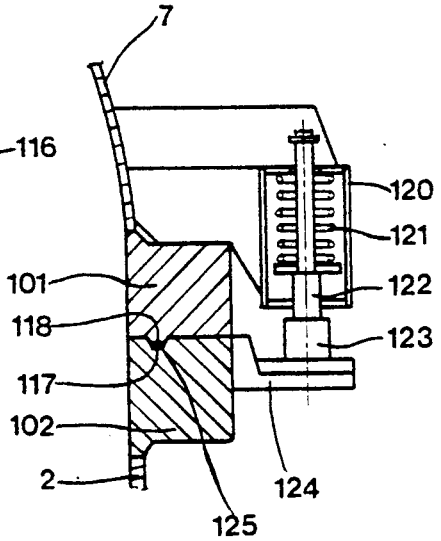
FIG. 8 is a detail view of another alternative embodiment of the damping systems for positioning and removing the cover of the vessel.

FIG. 8 shows another alternative embodiment of these dampers, placed, in this case, outside the flanges. In this alternative embodiment, a damper housing 120 is fixed on the cover 7. This housing contains a spring 121 compressed by a shoulder of a damper rod 122 which carries a block 123 which bears, when the cover is positioned on the vessel, on a support plate 124 fixed on the flange 102 of the vessel. In this alternative embodiment, it is necessary to position the cover relative to the vessel during its positioning in order for the blocks 123 to be opposite the support plates 124.

A description will now be given of the various stages of a method for pressure casting a slab implementing the various mechanisms described above.

Before the cast, the carriage 5 is in a waiting position distant from the mould 1, the cover being removed and the ladle having been taken out. The cover 7, equipped with the spout 3, rests via its flange 101 on a furnace located close by into which the spout 3 penetrates in order to be heated up and to be kept at temperature.

The ladle containing the molten steel which has come from the steelworks is placed in the vessel 2 on the ladle-carrier framework 9 held in the low position.

The cover equipped with the spout is then raised and displaced in order to position it on the vessel. During this handling, the risks of damage to and of breakage of the spout 3 are considerably reduced by virtue of the means for fixing the spout on the cover, described above in their second alternative embodiment, which permit a certain freedom of movement of the spout relative to the cover. The cover is positioned on the vessel without jolts by virtue of the dampers 119. During the descent of the cover, the slag floating on the molten metal is moved away from the zone where the spout penetrates in order to avoid introducing it into the latter. This may be done by blowing argon or nitrogen into the spout from its upper end or by scraping the central part of the surface of the metal in order to remove the slag therefrom or, alternatively, by bubbling, that is to say by introducing a neutral gas via the bottom of the ladle. It is also possible to provide a fusible cap which temporarily covers the lower end of the spout during the period in which the cover is being positioned.

Once the cover 7 has been set down and centred on the vessel 2, it is locked by virtue of the locking means 8 of the cover previously described.

The carriage carrying the assembly thus formed is then displaced in order to place it in the casting position beneath the mould 1.

The mould is then tilted and the valve device 17, previously open, comes to bear on the upper end of the spout, thereby pressing the ring 77 of the means for fixing the spout on the cover against its seating 75. The pressure exerted by the mould in combination with plastic seals inserted between the valve device and the spout provide the leaktightness of the join.

The actual casting operation can then commence. To this end, compressed air at a pressure of 1 to 8 bars or more is injected into the vessel, which causes the rise of the molten metal in the spout and then into the mould. The pressure is regulated according to a programme which continuously takes into account the quantity of metal introduced into the mould and the variations in the horizontal cross-sections of the mould encountered by the metal during its rise into the mould. When the mould is full, the valve device is closed and the internal pressure of the vessel is returned to ambient pressure.

The carriage can then be displaced to another mould where the operations described above are repeated.

The ladle is held in the low position while the level of metal in the ladle is greater than a predetermined level and thus while the quantity of metal in the ladle is greater than a corresponding predetermined quantity.

When the metal in the ladle reaches this predetermined level, close to and above the lower end 31 of the spout, the operation of raising the ladle is commenced. The level of metal in the ladle is calculated on the basis of the measurement of the weight of the ladle/metal together, incorporating the dimensional characteristics of the ladle and the (sic) of the spout.

When the weight corresponding to the desired predetermined level of the metal has been reached, raising is triggered. The total path of the raising is determined so as to obtain, at the end of the path, a minimum distance between the bottom of the dish 33 and the lower end 31 of the spout 3 so as to leave as little metal as possible in the bottom of the ladle.

As has been stated, the pressure in the vessel is regulated during the cast. The rise of the steel in the mould is obtained by an increase in the pressure in the vessel. It is thus necessary continuously to control, on the one hand, the value of the pressure and, on the other hand, the momentary value of the variation in the pressure as a function of time. Control of the reference (dP/dt), which represents the variations in pressure P as a function of time t, makes it possible to control the speed of rise of the metal into the mould.

On raising the ladle, this raising would tend to cause a corresponding rise in the molten metal in the mould.

In the absence of additional regulation, the speed of this rise, would be added to the speed resulting from the reference (dP/dt) which determines the pressure which must be created at any time in the vessel. As the objective is to control the speed of rise of the metal into the mould, a reference correction is necessary. Moreover, the measurement of pressure represents the height of steel in the mould only if the correction corresponding to the raising height of the ladle is made since, as the raising of the ladle creates a corresponding variation in the level of metal in the ladle relative to the level of metal in the mould, it follows that there is a variation in the ferrostatic height between these two levels.

It is thus appropriate to provide additional regulation by performing the following corrections:

a) Correction of the reference (dP/dt): during the duration of raising the ladle, the reference (dP/dt) becomes (dP1/dt)−V, where dP1 is the reference before correction and V is the speed of rise of the ladle.

b) Correction of the pressures P (I) of change of reference : the changes of reference (dP/dt) must be performed for a new reference pressure P′ (I)=P (I)−DPC, where P(I) is the pressure of change of reference before correction and DPC is the value of the vertical displacement of the ladle at the time t, the pressure values being corrected, in these formulae, to corresponding heights of steel.

At the end of draining the vessel, it is also necessary to ensure that no slag or air passes into the spout, which would risk causing splashes of steel outside the mould. The objective is to stop the cast when only the dish of the vessel contains molten metal, the lower end of the tube then being still immersed in this metal.

To this end, the variations in the time of two variables are analyzed: ($\Delta m/\Delta P$) and ($\Delta m/\Delta t$), where $\Delta$ P represents the variation of the pressure in the vessel and $\Delta$ m the variation in weight of the metal contained in the ladle as a function of time $\Delta$ t. In fact, when the level of steel in the ladle reaches the upper part of the dish, the said variables ($\Delta m/\Delta P$) and $\Delta m/\Delta t$) decrease rapidly. Typically, the cast will be stopped when predetermined variations of ($\Delta m/\Delta P$) and of $\Delta m/\Delta t$) are obtained according to the reference values.

When the cast is completed and the ladle is empty, the latter is lowered again into the low position and the carriage 2 (sic) is brought to its waiting position in which the cover is unlocked, removed and placed on the furnace where the tube is kept at temperature with a view to a subsequent casting cycle.

The description which has just been given of the casting method is not exhaustive in all its stages. This description is restricted to the essential phases which are specific to the method according to the invention and which can, moreover, be adapted to the individual characteristics of each pressure-casting installation.

We claim:

1. Device for feeding molten metal to a mould of a pressure-casting installation, comprising a vessel equipped with a cover carrying a spout, the said vessel resting on a frame and comprising a framework for supporting a ladle of molten metal, means for weighing the said ladle, and means for raising the said framework relative to the said vessel.

2. Device according to claim 1, wherein the framework for supporting the ladle comprises arms extending radially and bearing on the raising means distributed at the periphery of the vessel and supported by the frame.

3. Device according to claim 2, wherein the said raising means and weighing means are disposed outside the perimeter of the vessel and leaktight means are disposed at the level of the said raising and weighing means between the vessel and the frame.

4. Device according to claim 3, wherein the arms which extend radially beyond the perimeter of the vessel are fixed to the ladle-carrier framework in a retractable manner so that they can be displaced into a position inscribed inside the perimeter of the vessel.

5. Device according to claim 3, wherein each of the weighing and raising means comprises, in a substantially vertical alignment, a balance on which the arm bears, a guiding column and a jack, connecting rods provided with pivots being disposed between the guiding column and, on the one hand, the balance and, on the other hand, the movable rod of the jack, the said column being guided in a sleeve fixed to the frame.

6. Device according to claim 5, wherein the guiding column comprises a shoulder capable of bearing on the sleeve.

7. Device according to claim 1, that the spout is fixed on the cover by means of a pivot device.

8. Device according to claim 7, wherein the pivot device comprises a collar surrounding the spout in a leaktight manner and connected to a ring comprising a spherical bearing surface bearing on a frustoconical seating of the cover.

9. Device according to claim 8, wherein the ring is held on the cover by clips wedges of an adjustable thickness being disposed between the clips and the cover in order to adjust the position of the ring relative to the cover.

10. Device according to claim 8, wherein the ring comprises at least three lugs distributed circumferentially, reference wedges and compression springs are interposed between the said lugs and the cover, the thickness of the said wedges being such that, when the lugs bear on them, the spherical bearing surface of the ring is in leak-tight contact with the frustoconical seating of the cover and the said springs being such that, in the absence of a downward thrust exerted on the spout, play remains between the ring and the cover.

11. Device according to claim 1, comprising means for locking the cover on the vessel, the cover and the vessel being equipped with flanges provided in order to come into leaktight contact upon one another, characterized in that the said locking means comprise a plurality of C-shaped locking pieces distributed at the periphery of the vessel, mounted so as to pivot on the latter and the branches of which surround the said flanges in the locking position.

12. Device according to claim 11, wherein two adjacent C-shaped locking pieces are connected by the same jack for controlling the pivoting.

13. Device according to claim 11, wherein each C-shaped looking pieces comprises, on a branch, a stop bearing on a flange and, on the other branch, a clamping jack pressing on the other flange.

14. Device according to claim 11, wherein dampers for positioning the cover are placed between the flange of the cover and the flange of the vessel.

15. Method for pressure casting, according to which molten metal is fed to a mould by injecting the molten metal into the said mould by means of a spout fixed on the cover of a vessel and immersed in a ladle containing the said metal, the metal being pushed into the spout through the action of the internal pressure created in the vessel, wherein, when the quantity of metal in the ladle is greater than a specific quantity, the said ladle is held in a low position, and when the quantity of metal in the ladle becomes less than the said specific quantity, the ladle is raised so as to hold the lower end of the spout below the level of the metal contained in the said ladle.

16. Method according to claim 15, wherein, when the ladle is raised, the internal pressure of the vessel is regulated so as to maintain a predetermined speed of rise of the metal into the mould.

* * * * *